US005342279A

United States Patent [19]

Cooperstein

[11] Patent Number: 5,342,279

[45] Date of Patent: Aug. 30, 1994

[54] DECANTER CENTRIFUGE HAVING DUAL MOTOR DRIVE

[75] Inventor: Joseph L. Cooperstein, Philadelphia, Pa.

[73] Assignee: Alfa Laval Separation Inc., Warminster, Pa.

[21] Appl. No.: 931,758

[22] Filed: Aug. 18, 1992

[51] Int. Cl.[5] ..... B04B 9/10

[52] U.S. Cl. ..... 494/9; 494/53; 494/84

[58] Field of Search ..... 210/380.1, 380.3; 494/7, 8, 9, 51, 52, 53, 54, 37, 84; 318/34, 77, 101, 102, 103, 112, 41, 45, 461, 466; 68/12.14, 19.2, 140; 317/771

[56] References Cited

U.S. PATENT DOCUMENTS

| | | | |
|---|---|---|---|
| 499,346 | 6/1893 | Peck . | |
| 873,593 | 12/1907 | Phillips . | |
| 965,558 | 7/1910 | Berrigan . | |
| 1,013,113 | 1/1912 | Berrigan . | |
| 1,062,215 | 5/1913 | Berrigan . | |
| 1,564,665 | 12/1925 | Gates . | |
| 1,995,157 | 3/1935 | Riggs | 318/771 |
| 2,056,888 | 10/1936 | Pecker | 494/84 |
| 2,070,192 | 2/1937 | Zarafu | 68/140 |
| 2,182,646 | 12/1939 | Shutt | 318/771 |
| 2,228,949 | 1/1941 | Field | 24/152 |
| 2,596,616 | 5/1952 | Strezynski | 233/18 |
| 2,709,775 | 5/1955 | Del Carlo | 318/771 |
| 2,867,378 | 1/1959 | Harlow | 233/7 |
| 2,907,517 | 10/1959 | Ziherl | 233/7 |
| 2,955,753 | 10/1960 | O'Conor et al. | 233/4 |
| 3,126,337 | 3/1964 | Smith | 233/4 |
| 3,172,851 | 3/1965 | Ambler | 233/7 |
| 3,256,993 | 6/1966 | Siepe | 210/380.1 |
| 3,706,412 | 12/1972 | Latham, Jr. | 233/1 B |
| 3,734,399 | 5/1973 | Oas | 233/7 |
| 3,923,241 | 12/1975 | Cyphelly | 233/7 |
| 4,035,701 | 7/1977 | Jensen | 318/771 |
| 4,073,431 | 2/1978 | JÄger | 233/7 |
| 4,141,488 | 2/1979 | Gense | 233/7 |
| 4,142,669 | 3/1979 | Burlet | 233/7 |
| 4,240,578 | 12/1980 | Jackson | 233/7 |
| 4,254,904 | 3/1981 | Ostermeyer et al. | 233/2 |
| 4,299,353 | 11/1981 | Bruning et al. | 233/7 |
| 4,303,192 | 12/1981 | Katsume | 233/7 |
| 4,421,502 | 12/1983 | Jakobs | 494/7 |
| 4,457,746 | 7/1984 | Feterl | 494/47 |
| 4,504,262 | 3/1985 | Forsberg | 494/53 |
| 4,518,899 | 5/1985 | Wolf | 318/86 |
| 4,668,213 | 5/1987 | Kramer | 494/37 |
| 4,689,527 | 8/1987 | Wu | 318/45 |
| 4,776,832 | 10/1988 | Martin et al. | 494/19 |
| 4,829,230 | 5/1989 | Perry | 323/273 |
| 4,965,463 | 10/1990 | Maruyama | 318/102 |
| 4,978,331 | 12/1990 | Luchetta et al. | 494/37 |
| 5,068,559 | 11/1991 | Satake | 318/771 |

FOREIGN PATENT DOCUMENTS

| | | |
|---|---|---|
| 2848547 | 11/1978 | Fed. Rep. of Germany . |
| 3409112A1 | 3/1984 | Fed. Rep. of Germany . |
| 56-4292 | of 0000 | Japan . |
| 2099334A | 5/1981 | United Kingdom . |

*Primary Examiner*—Timothy F. Simone
*Assistant Examiner*—Terrence R. Till
*Attorney, Agent, or Firm*—Seidel, Gonda, Lavorgna & Monaco

[57] ABSTRACT

A decanter centrifuge is provided with a dual motor drive for purposes of start-up and efficient operation. The two motors are coupled together during, at least, the start-up of the centrifuge rotation so as to provide the desired power requirements and to reduce the thermal load on the motors. After reaching operational speed, a first motor continues to drive the centrifuge at the desired operational speed and the second motor may be disengaged from operation. The dual motor drive may be varied by use of wye-start and delta-run phase connections for the motors. The operating conditions of the two motors can be varied to provide the necessary power while maximizing efficiency of the operation.

10 Claims, 2 Drawing Sheets

DECANTER CENTRIFUGE HAVING DUAL MOTOR DRIVE

FIELD OF THE INVENTION

The present invention relates to decanter centrifuges and particularly to the motor drive for the bowl of the centrifuge. Specifically, the present invention relates to a dual motor drive for purposes of the start-up of the decanter centrifuge and to the operation of the dual motor drive for purposes of maximizing efficiency during start-up and operation.

BACKGROUND OF THE INVENTION

Typically, decanter centrifuges use an electric motor (either DC or AC) to rotate the bowl of the centrifuge. The rotation of the bowl creates a centrifugal force for separation of the constituent parts of the feed slurry. A separate driving element is provided to rotate the conveyor portion of the decanter centrifuge at a differential rotational speed with respect to the rotation of the bowl. This differential speed of the conveyor creates a discharging force on the separated heavy phase or solids material and moves same toward the discharge outlets in the bowl.

In order to start the rotation of a decanter centrifuge and bring it up to operational speed, the inertia of the centrifuge must be overcome. In addition, the windage resistance and frictional resistance of the centrifuge during rotation (which changes with the speed of rotation) must be overcome. The inertial and other resistance may place a substantial burden on the motor drive due to the high current and long acceleration time required of the motor. This burden on the motor may exceed that resulting from the maintenance of the operational speed of the centrifuge.

Previously, decanter centrifuges were of a size which permitted the application of standard motor technology for start-up and for normal operation. If the centrifuge exceeded the limitations of a particular motor, during starting or normal operation, other elements such as fluid couplings, transmissions, variable frequency drives, direct current motors, mechanical or hydraulic clutches were provided. However, in some applications these elements are not desirable or preferred. Alternatively (or in addition to the above elements), special heavy duty motors were provided. However, as the size and speed of the centrifuge bowl has increased, the burden on the motor drive has substantially increased.

The "heavy duty" construction of the motor includes additional structure and special materials for purposes of withstanding the heat build-up created during start-up. The cost of these special "heavy duty" motors substantially increases with size due to the significant increase in the quality, strength and amount of the materials required to create the desired properties of the motor. Additionally, the size of the motor and the size of the associated support frame substantially increase.

The increase in "size" of a "heavy duty" motor may also result in a loss of efficiency at normal operational speeds. This may be due to the special design for thermal load at start-up. Preferably, a motor would allow start-up to occur and then operate at full efficiency at normal operating speeds.

BRIEF SUMMARY OF THE INVENTION

The present invention relates to a decanter centrifuge having a dual motor drive for purposes of start-up and operation. The two motors are coupled together during, at least, the start-up of the centrifuge rotation so as to provide the desired power and/or thermal requirements. After reaching operational speed, a first motor continues to drive the centrifuge at the desired operational speed. The second motor may be switched or disengaged either mechanically or electrically. This relationship allows the first motor to continue to operate under efficient operating conditions. The dual motors for driving the centrifuge during start-up are provided in addition to the back drive motor, if such is provided.

Another aspect of the invention is the variation of the operational conditions of the dual motor drive so as to provide the necessary power for both normal operation and for start-up while limiting the thermal build-up during start-up. This aspect of the invention includes the use of wye/delta or other control on the motors. The operating conditions of the two motors can be varied to provide the necessary power while maximizing the efficiency of operation.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
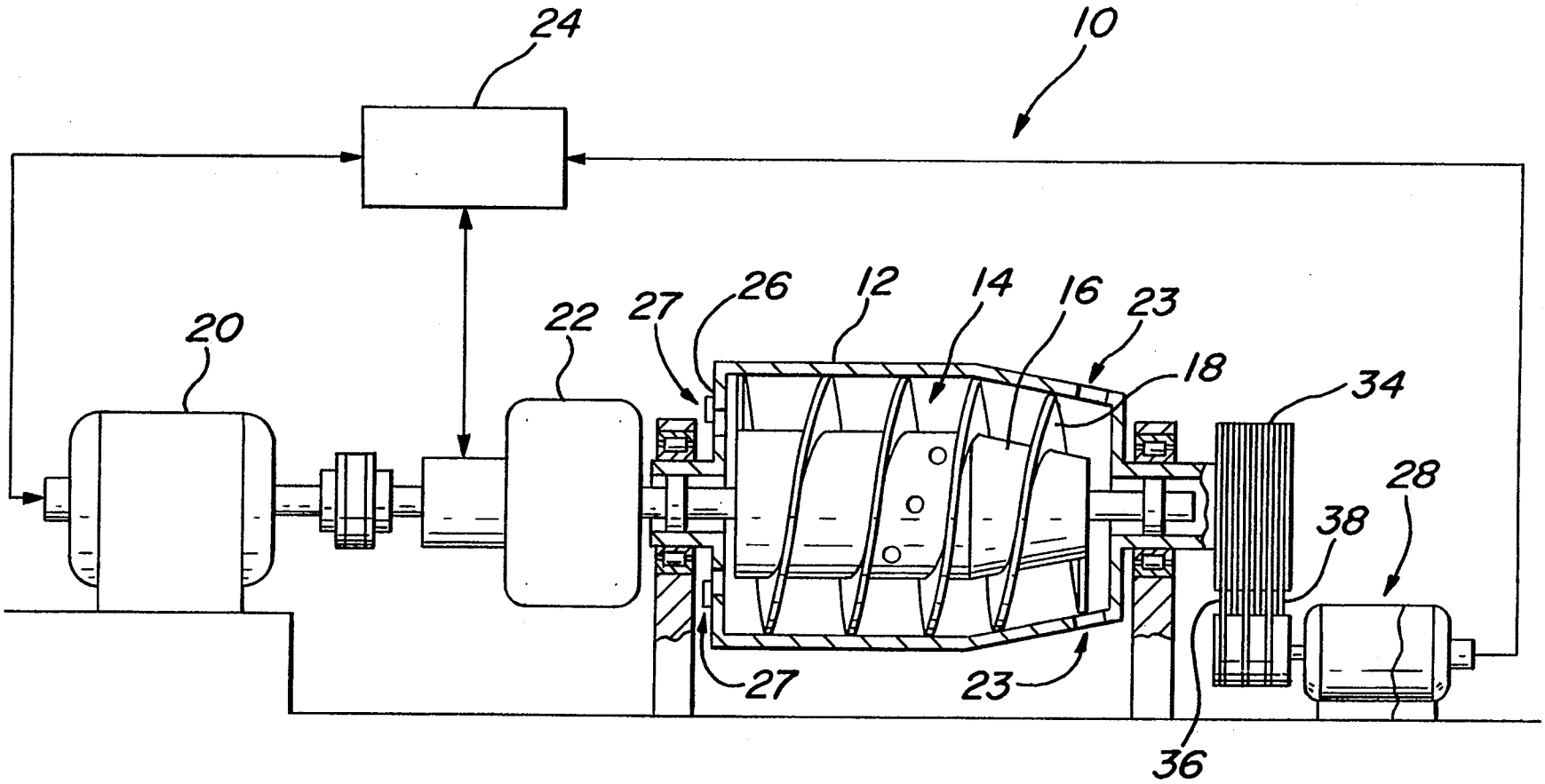
FIG. 1 shows a side elevation of a decanter centrifuge operating in accordance with the present invention.

In the drawings, where like numerals identify like elements, there is shown a decanter centrifuge apparatus which is generally referred to by the numeral 10. As illustrated in FIG. 1, the decanter centrifuge 10 comprises a solid or imperforate bowl 12 mounted for rotation about its longitudinal axis. The bowl 12 of a decanter-type centrifuge typically comprises a cylindrical portion at one end and a frusto-conical portion at the opposite end. Coaxially mounted for rotation within the bowl 12 is a screw conveyor 14. The conveyor 14 generally comprises a central hub 16 and a series of conveyor flights 18 helically wound around the hub 16 and radially extending from the hub 16 to a position adjacent the inside wall of the bowl 12.

The rotation of the bowl 12 of the decanter centrifuge 10 creates a centrifugal force on the feed slurry introduced therein (not shown) which separates according to density into a light phase (primarily a liquid) and a heavy phase (typically a mixture of solids and liquid). The screw conveyor 14 is rotated at a differential speed with respect to the bowl 12 so as to create a discharging force on the heavy phase material, which separates from the feed mixture and accumulates along the inside wall of the bowl 12 as a result of the centrifugal force. A back drive motor 20 or the like creates the differential speed of the conveyor 14 through a gear box 22. Control of the differential speed of the conveyor 14 is made through controller 24. The relative speed of the conveyor 14 with respect to the bowl 12 moves the separated heavy phase along the bowl wall toward the restricted end of the frusto-conical portion of the bowl 12.

A series of discharge openings 23 are provided at the restricted end of the frusto-conical portion of the bowl 12 for discharging the separated heavy phase.

As a result of the centrifugal force acting on the feed, the clarified liquid or light phase material moves radially inward in the bowl 12. Typically, a series of discharge ports 27 are provided for discharge of the light phase from the bowl 12. These discharge ports 27 are shown in FIG. 1 on the bowl hub 26 located at the cylindrical end of the bowl 12.

Figure 2:
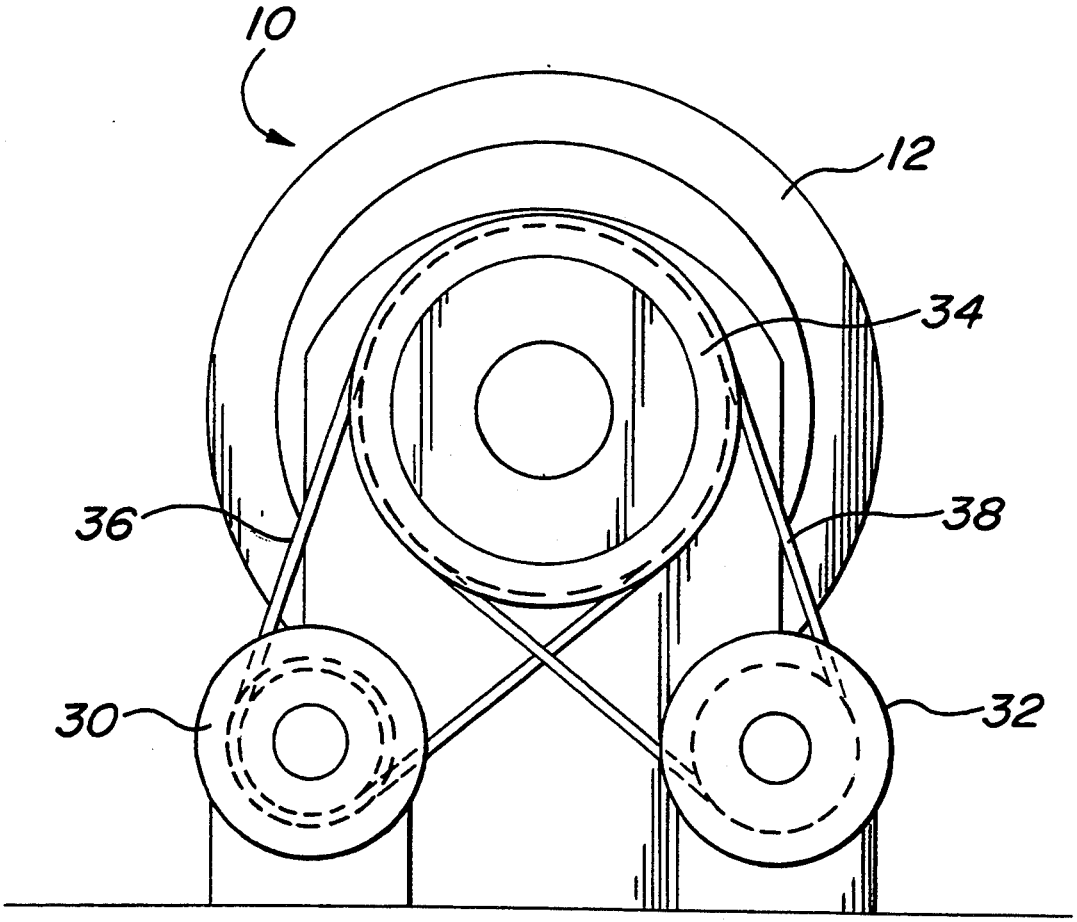
FIG. 2 is a front elevation of the decanter centrifuge in accordance with the present invention as shown in FIG. 1.

As illustrated in FIG. 2, the rotation of the bowl 12 is created through drive means 28. Drive means 28 comprises a first motor 30 and a second motor 32. Both motors 30, 32 are connected to the drive pulley 34 by drive belts 36, 38, respectively. Thus, when both motors 30, 32 are operating, the rotation of the bowl 12 is effectuated by the combination of the two motors.

An alternate arrangement for the drive means 28 would be for first motor 30 to include a double shaft, connecting one shaft to the drive pulley 34 and the second shaft (not shown) to the second motor 32. In this configuration, motor 32 may be connected to motor 30 by means of a suitable coupling, clutch or other mechanical or electrical device. This combination would effectuate the rotation of the centrifuge 10 in substantially the same manner as that arrangement shown in FIG. 2.

It is contemplated that either motor 30 or motor 32 may have sufficient power to rotate the bowl 12 at the desired operational speed(s). During start-up, the second motor 32 is engaged to assist the first motor 30 in rotating the bowl 12. By the use of the two motors 30, 32 during start-up, sufficient power is provided to overcome the inertia of the centrifuge 10 as well as the windage, friction and other forces resisting rotation. Upon receipt of a control signal from the controller 24, the second motor 32 may be disengaged from operation. Once disengaged, belts 38 turn the pulley (shown in phantom in FIG. 2) connected to the second motor 32 without the motor creating significant resistance. The second motor 32 may also be switched on or re-engaged during operation to provide additional power to assist the first motor 30. This additional power may be required to raise the speed of rotation or to provide additional torque to assist the first motor 30.

By way of example, but not limiting on the size and construction of the present invention, a decanter centrifuge produced by Alfa-Laval Separation, Inc. of Warminster, Pa. (the assignee of the present invention) and sold under the name SHARPLES (registered trademark) PM76000 has an inertia of approximately 8000 lb.ft.$^2$ and a normal operating speed of 2800 rpm. The inertial resistance created by the centrifuge 10 has an effect on the motor which is a function of the belt ratio between the motor and the bowl. This relationship is defined by the following formula:

$$I_{motor}=I_{bowl}\times(rpm_{bowl}/rpm_{motor})^2 \quad (1)$$

(Where $rpm_{motor}$ is the operational speed for the motor.)

For the SHARPLES PM76000 centrifuge, this relationship results in an inertia that the motor sees of approximately 20,000 lb.ft.$^2$. This inertial resistance (in conjunction with the varying windage and functional resistance) can be converted into a thermal effect on the motor by the motor manufacturer.

One motor for the SHARPLES PM76000 centrifuge is a heavy duty model 449T, using standard NEMA designations, as manufactured by Reliance Electric Corp. of Euclid, Ohio. This "400 series" motor is operating close to its thermal capacity limit during start-up. In order to increase the size of the motor, a 5000 series motor would be required, including a non-standardized frame. This increased motor size may become a requirement for a centrifuge with a larger inertia or if the same size centrifuge is to be run at a higher speed such as the SHARPLES PM76000B centrifuge which is run at 3200 rpm. An additional speed or size requirement raises the inertia seen by the motor (as calculated using equation (1) above). In the case of the SHARPLES PM76000B, the inertia seen by the motor is approximately 26,000 lb.ft.$^2$. This inertial resistance (again coupled with the windage and frictional resistance) is approximately the maximum thermal capacity for the 400 series motor.

The SHARPLES PM95000 centrifuge is a larger centrifuge intended to operate a 2300 rpm and has an inertia of 23,000 lb.ft.$^2$. This construction results in an inertia as seen by the motor of 37,000 lb.ft.$^2$. Previously, this type centrifuge was started using a fluid coupling, which in many situations is not preferred, although sometimes necessary because the resistance during start-up creates a load in excess of the thermal capacity of a 400 series motor.

Other large decanter centrifuges have been proposed having inertias which are higher. These constructions will result in even higher inertias as seen by the motor. Again, this resistance would cause a thermal build-up within a single 400 series motor which may be in excess of its capacity.

Under the terms of the present invention, two motors may be used to drive the centrifuge during start-up. The use of the two motors reduces the thermal load on each. Thus, a large centrifuge (such as a PM95000 as discussed above) could be driven using 400 series motors. This would eliminate additional expenditures for a larger motor (such as a 5000 series motor, which exceeds that of two 400 series motors) and/or the other identified equipment and the operational and physical drawbacks resulting therefrom. When comparing all the necessary parts, the cost of using two motors is usually cheaper than that of a single "heavy duty" motor.

Another result of using a dual motor drive is to permit the application of standard size motors in a broad-range of centrifuge sizes. In addition, as the size of the centrifuge increases, whether it be in diameter or length, and/or as the speed of the centrifuge for normal operation increases (a change that also increases the inertial resistance seen by the motor drive means), the same motors may be applied in varying combinations to meet the requirements of centrifuge start-up.

Another embodiment of the present invention includes the use of wye and delta phase controls or similar starter systems to control the motor(s). The switching of the motor between wye and delta would be to conform the motor(s) to meet the power requirements of the centrifuge while reducing thermal build-up within the motor and while maximizing efficiency.

The switching of the wye/delta characteristics of the two motors 30, 32 can be controlled at controller 24. For example, the two motors 30, 32 may both be placed in the wye mode at start-up. This mode will provide sufficient power and torque to bring the centrifuge 10 to full operational speed at a reduced voltage. The reduction in voltage also results in a current draw reduction and, thus, a reduced thermal stress on the motor and to the power grid of the user. The wye mode will result in a longer start-up period but still reduces the effect of the power draw requirements for the centrifuge. After reaching a certain speed, the first motor 30 may be switched to run in the delta mode. This switch provides additional power and torque for rotation of the bowl 12 upon introduction of the feed. The second motor 32 may then be switched off at that point.

In some applications, normal centrifuge operation will require power from the second motor 32 over the capabilities of the delta mode of the first motor 30. However, the full power of the second motor 32 may not be required in addition to that of the first motor 30. In this application, the second motor 32 can continue to run in the wye mode. If full power is required, the second motor 32 can be switched to operate in the delta mode along with the first motor 30. For example, heavy duty 400 series motor(s) having a power rating of 100 HP in the wye mode and 300 HP in the delta mode can be used in accordance with the present invention to start-up each of the centrifuges discussed above. The power output can be varied on the dual motors 30, 32, via the removal of operation of the second motor 32 or the shift of the wye/delta mode of operation of the motors, to provide the power necessary and to maximize operational efficiency. Other combinations of these operating modes are also contemplated by the present invention.

Control of the operation of the two motors 30, 32 by controller 24 may be effectuated in a number of ways. For example, a current or load sensor could be positioned on the input line to the motors 30, 32. Other sensor parameters for this type control include thermal load, efficiency, etc. As the load varies, a function of the resistance to rotation by the centrifuge due to inertia, windage, conveyance of the heavy phase, etc., the controller 24 may react to switch the operation of the two motors 30, 32. This switching can be made at various conditions or set points and may include the on/off operation of the second motor 32 and/or the variation of wye/delta mode for the two motors. Thus, controller 24 may be reactive to the load to place each motor in the wye mode, the first motor in delta and the second motor in an off condition, the first motor in delta and the second motor in wye, both motors in delta, etc. The parameters of this control may vary according to application and to the specification of the centrifuge manufacturer or the like.

The present invention, whether or not used in conjunction with the wye/delta operation, provides a capital and operating cost reduction for the power equipment of larger centrifuges and permits standardization of parts for various centrifuges, thus providing additional economies. The wye/delta mode combinations permit the motors to run at a higher efficiency as compared to operation of a single "heavy duty" motor at a reduced efficiency. Further advantages are obtained by the centrifuge user due to an increase in the power factor for the overall centrifuge operation. Because the centrifuge will be run closer to its maximum efficiency and the peak power requirement will be reduced, the actual power usage will more closely approach the maximum capabilities of the motor drive.

The present invention may be embodied in other specific forms without departing from the spirit or essential attributes thereof, and accordingly, reference should be made to the appended claims, rather than to the foregoing specification, as indicating the scope of the invention.

I claim:

1. A decanter centrifuge comprising: a bowl mounted for rotation about a central longitudinal axis, means for rotating the bowl including a first and second motor which combine to rotate the bowl during a least a portion of the centrifuge operation, a conveyor coaxially mounted within the bowl, means for rotating the conveyor at a differential speed with respect to the bowl, and control means for initiating the operation of the first and second motor during initial start up of the bowl and for disconnecting the second motor during operation upon the bowl reaching desired operational speed.

2. A decanter centrifuge as claimed in claim 1 wherein at least one of the motors includes a wye/delta mode control and wherein the control means is adapted to switch the motor between wye and delta under certain operational conditions of the centrifuge.

3. A decanter centrifuge as claimed in claim 2 wherein both the first and second motors include a wye/delta mode control.

4. A decanter centrifuge as claimed in claim 3 wherein the control means is adapted to switch the two motors between wye and delta modes in various combinations.

5. A decanter centrifuge as claimed in claim 4 wherein the control means is adapted for switching the operation of the two motors between the wye and delta modes dependent upon the load on the motors.

6. A method of operating a decanter centrifuge having a bowl mounted for rotation about its central longitudinal axis and a screw conveyor coaxially mounted within the bowl and adapted for rotation at a differential speed with respect to the bowl, comprising the steps of: providing a first and second motor for rotation of the bowl, increasing the speed of rotation of the bowl to operational speed by the combined operation of the two motors, and upon reaching the desired operational speed disconnecting the second motor from contributing to the rotation of the bowl while continuing to rotate the bowl by the operation of the first motor.

7. The method of claim 6 further comprising the steps of: providing the first motor with a wye/delta mode control.

8. The method of claim 7 further comprising the steps of initiating the increase in speed of rotation of the bowl by the first and second motor with the first motor in the wye phase control mode and switching the first motor to the delta phase control mode during operation.

9. A decanter centrifuge comprising: a bowl mounted for rotation about its longitudinal axis, a conveyor coaxially mounted within the bowl, means for rotating the bowl, the rotating means comprising a first motor and a second motor, the first and second motors combining to rotate the bowl during at least start-up of the centrifuge, means to limit the thermal build-up within the first and second motors and for controlling the operation of the first and second motor, including means for disconnecting the second motor from operation and from rotating the bowl upon the bowl reaching a desired operational speed, and means for rotating the conveyor at a differential speed with respect to this bowl during operation of the centrifuge.

10. A decanter centrifuge as claimed in claim 9 wherein the control means further comprises a phase control means for at least one of the motors and is adapted to control the operation of the first and second motors dependent upon the load on the motors created by the operation of the centrifuge and for switching the phase of the motor dependent upon the load.

* * * * *